United States Patent [19]

Ellegast et al.

[11] 4,095,558

[45] Jun. 20, 1978

[54] COATING APPARATUS

[75] Inventors: Konrad Ellegast, Leichlingen; Fritz Feld, Leverkusen; Karlheinz Feltgen, Straberg; Horst Greiner, Cologne; Armin Köhler, Dormagen; Wolfgang Kühn, Leverkusen; Richard Menold, Leverkusen; Heinrich Nassenstein, Leverkusen; Roland Weisbeck, Odenthal-Voiswinkel, all of Germany

[73] Assignee: Bayer Aktiengesellschaft, Leverkusen-Bayerwerk, Germany

[21] Appl. No.: 822,915

[22] Filed: Aug. 8, 1977

Related U.S. Application Data

[60] Continuation of Ser. No. 605,146, Aug. 15, 1975, abandoned, which is a division of Ser. No. 526,411, Nov. 22, 1974, abandoned.

[30] Foreign Application Priority Data

Nov. 28, 1973 Germany ..... 2359276

[51] Int. Cl.[2] ..... B05C 3/12; B05C 5/02

[52] U.S. Cl. ..... 118/420

[58] Field of Search ..... 118/420, 419, DIG. 19, 118/DIG. 22, 410, 401, 234; 427/117-120, 244, 355-358, 434 R, 434 D; 68/200

[56] References Cited

U.S. PATENT DOCUMENTS

| | | | |
|---|---|---|---|
| 1,934,796 | 11/1933 | Friederich | 118/DIG. 19 |
| 2,963,739 | 12/1960 | Whitehurst et al. | 118/DIG. 19 |
| 2,977,929 | 4/1961 | Whitehurst et al. | 118/401 |

*Primary Examiner*—Morris Kaplan
*Attorney, Agent, or Firm*—Plumley and Tyner

[57] ABSTRACT

The invention is related to a process for the quantitative application of liquid systems in a thin layer to natural or synthetic fibres or filaments travelling uniformly along a linear path by the one-way technique using a forced-dosage unit, distinguished by the fact that fibres or filaments are guided past at least one slot which is either curved or provided with partial curves, and are brought into contact with an optionally foamed liquid issuing from the slot.

2 Claims, 9 Drawing Figures

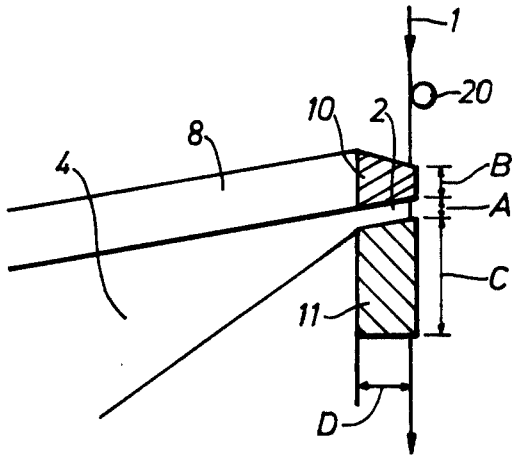
FIG. 3
FIG. 4a
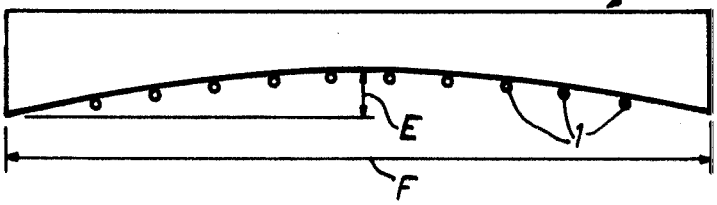
FIG. 4b
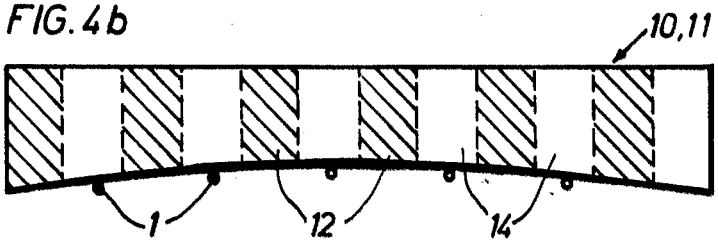
FIG. 4c
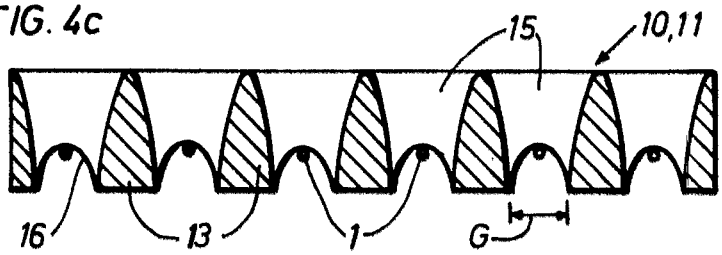

COATING APPARATUS

This is a continuation of application Ser. No. 605,146, filed Aug. 15, 1975 which is a division of Ser. No. 5,264,111, filed Nov. 22, 1974, each now abandoned.

This invention relates to an apparatus for the quantitative application of liquid systems in a thin layer to natural or synthetic fibres or filaments moving uniformly along a linear path by the one-way technique using a forced dosage unit.

Coating fibres and filaments with liquid systems, for example with spinning preparations, is aimed in particular at facilitating the friction-free movement of the threads. In addition, the coating is frequently used as an antistatic agent. Finally, the fibre has to be charged with water in dosed form. These requirements mean that the coating agent has to be in the form of an emulsion having an outer phase of water and an inner phase of oil.

In conventional processes for the application of such an emulsion, the filaments are run past a rotating porous roller (godet) the filaments contacting the roller at a tangent. The roller dips into an emulsion and transfers the emulsion to the filaments through its rotation and contact with the threads. The amount of emulsion transferred is determined inter alia by the speed of rotation. The emulsion in the pan is continuously replenished by a pumping system.

One disadvantage of coating processes of this kind is that there are many fluctuations in the amount of emulsion applied. These difficulties are predominantly attributable to the fact that the supply of emulsion on the roller is relatively large and the filaments take up as much emulsion as they can, depending on how they are guided over the roller. There is no means to make the fibres take up an accurately defined quantity. Also, the properties of the roller surface change with time; wear phenomena occur, and also the properties of the emulsion change, for example due to bacterial effects. Decay and ageing effects of this kind result in troublesome changes in viscosity and the consequential fluctuations in the amount of oil applied cause fluctuations in friction when the filaments are being stretched. The resulting stretching errors lead to differing fibre strengths, filament breakages occurring in extreme cases. In addition, fluctuations in the amount of water taken up result particularly in fluctuations in the crimping and dyeing properties of the fibres.

Apart from the application of spinning preparations to fibres by the roller method, it is known from German Offenlegungsschrift No. 2,035,081 the liquid, foamable smoothing or stiffening agents can be applied in foam form to a weft or warp yarn through a slot. A similar process is also described in our own earlier German Patent Application P23 25 827.7. However, it has been found that, when preparations are applied through a slot, particularly at high filament speeds, the previously described disadvantages are not completely avoided and the amount of preparation applied is still subject to fluctuations. The resulting increase in the size of the packages and the irregularities occurring in texturing and dyeing make it necessary to optimise already known preparation methods.

Accordingly, the object of the invention is to avoid the above mentioned disadvantages and difficulties.

It has now been found that emulsions and, quite generally, preparations or liquid systems, can be uniformly applied in dosable quantities to fibres or filaments travelling along a linear path, providing the liquid systems are applied, optionally in foamed form, to the filaments or fibres through a curved slot by the one-way technique.

Accordingly, the invention provides an apparatus for the quantitative application of liquid systems in a thin layer to natural or synthetic fibres or filaments travelling uniformly along a linear path by the one-way technique using a forced-dosage unit, wherein the fibres or filaments are guided past at least one slot which is either curved or provided with partial curves, and are brought into contact with an optionally foamed liquid issuing from the slot.

The apparatus is suitable for the application of preparations to natural or synthetic filaments or fibres at all the speeds normally used in production or after-treatment processes. According to a preferred embodiment the filaments or fibres are guided past a height-adjustable slot which is 0.1 to 1 mm tall and which is curved or provided with partial curves and which is adapted to the width of the sliver or to the number of filaments. The filaments or fibres are contacted with an optionally foamed liquid issuing from the slot, the linear speed of the issuing liquid being determined by the slot height at a predetermined flow rate per unit volume and the dose of liquid introduced in each short time interval being quantitatively taken up by the fibres.

If the liquid applied is an emulsion, the residence time of the liquid in each unit volume of the apparatus must be appreciably shorter than the average life of the emulsion.

Filaments, fibres or web structures of organic or inorganic, synthetic or natural materials are suitable for preparation by the process according to this invention. For example, fibres, filaments or web structures of polyamides, polyesters, polyacrylonitriles, polyolefins, carbon, glass, asbestos or aluminium oxide can be successfully coated with a series of known preparations by the apparatus according to the invention. Examples of such preparations are lubricants such as mineral oils, vegetable and animal oils, natural and synthetic waxes and ester oils (fatty acid esters or dicarboxylic acid alkyl esters); antistatic agents such as salts of partial esters of phosphoric acid with fatty alcohol polyglycol ethers or alkylphenol polyglycol ethers, and sulphuric acid esters of the above-named ethylene oxide adducts; emulsifiers such as ethylene oxide and/or propylene oxide adducts of fatty alcohols, fatty acids and fatty amines; wetting agents, such as sulphosuccinic acid esters and, optionally, additions of bactericides such as o-phenylphenol and p-chloro-m-cresol.

The apparatus according to the invention has proved to be particularly advantageous in the production of fibres and filaments from polyamides and polyethylene terephthalate. Depending on the particular production process or after-treatment process, it is possible in accordance with this invention to apply spinning preparations and brighteners at virtually any stage in the production of polyamide or polyethylene terephthalate fibres. Thus, the preparation can be transferred to the filaments in foamed or non-foamed form either in the spinning tube itself or directly after leaving the spinning tube, after stretching, before and after texturing, after fixing in the case of monofilaments and spun fibres and after dyeing and before or after twisting or winding with all filaments, yarns and tows etc. In spite of the very high speeds used in these processes, the liquid systems are quantitatively applied uniformly and in exactly measured quantities.

The apparatus according to this invention is suitable for applying foamed and non-foamed liquid systems, preferably emulsions, to fibres or filaments immediately after their production preferably either in the spinning tube itself or immediately after leaving the spinning tube.

In the production of polyamide-6 filament or yarn, it is preferred to apply from 1 to 7% by weight based on the substrate, of a spinning preparation.

This invention may be described, by way of example, with reference to the accompanying drawings wherein:

FIG. 3 is an enlarged cross-sectional view of the adjustable slot of the apparatus.

FIG. 4*a* is a plan view of the blocks forming the curved slot of FIG. 3 and showing how filaments are guided past the slot.

FIG. 4*b* is a plan view of another embodiment of the curved slot of FIG. 4*a* wherein the slot comprises a series of adjacent small openings for the outward flow of liquid.

FIG. 4*c* is a cross-sectional plan view of another embodiment of the slot of FIG. 4*b* wherein the face of the slot is fluted to provide channels as filament guides.

Figure 5:
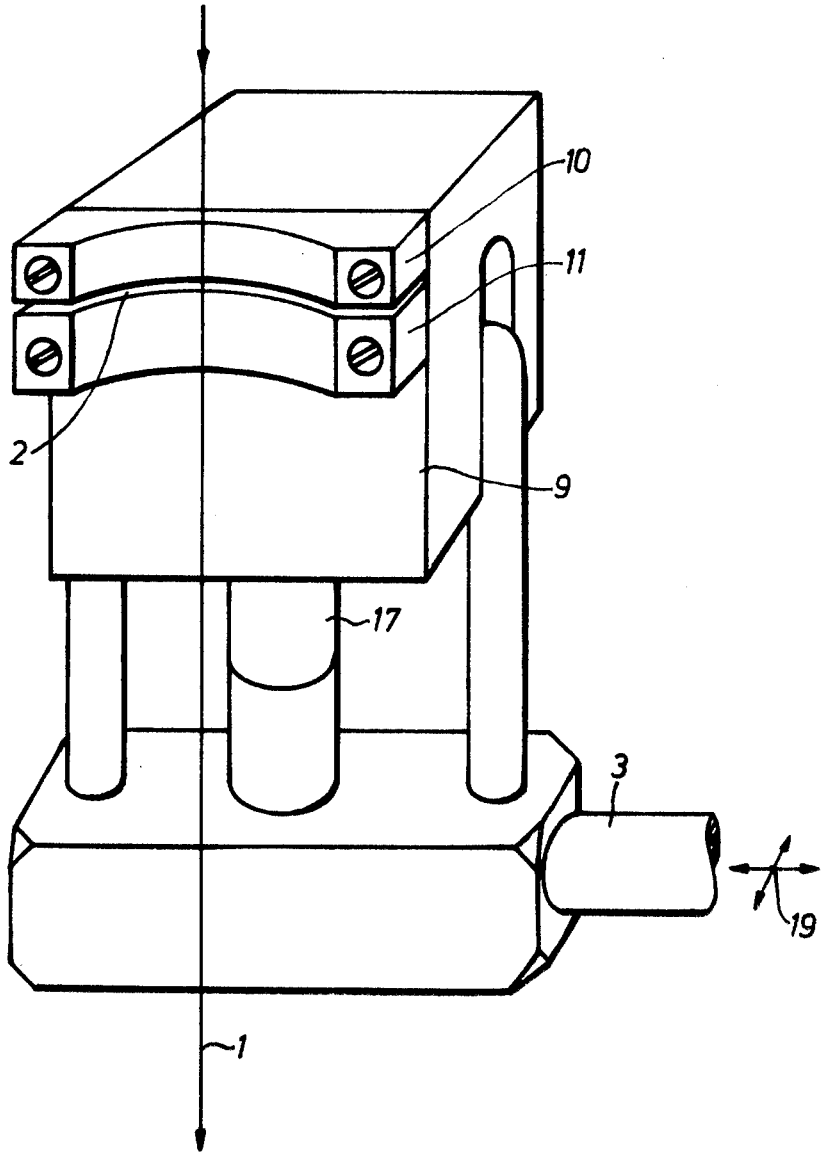

FIG. 5 is a perspective view of the apparatus employed for the process of this invention.

Figure 6:
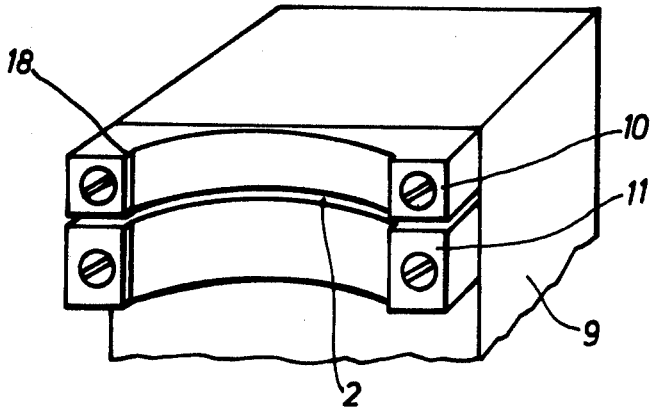

FIG. 6 is a partial perspective view of the curved slot and filament guide.

Figure 7:
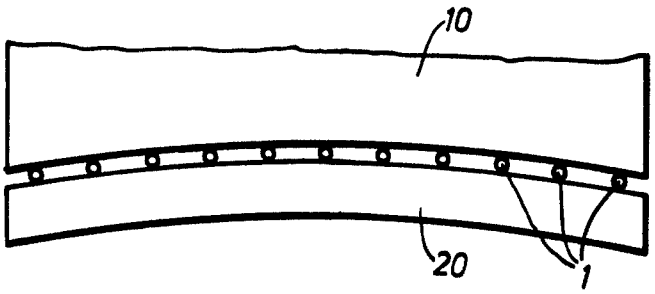

FIG. 7 is a partial plan view of the curved slot with an auxiliary filament guide.

Figure 1:
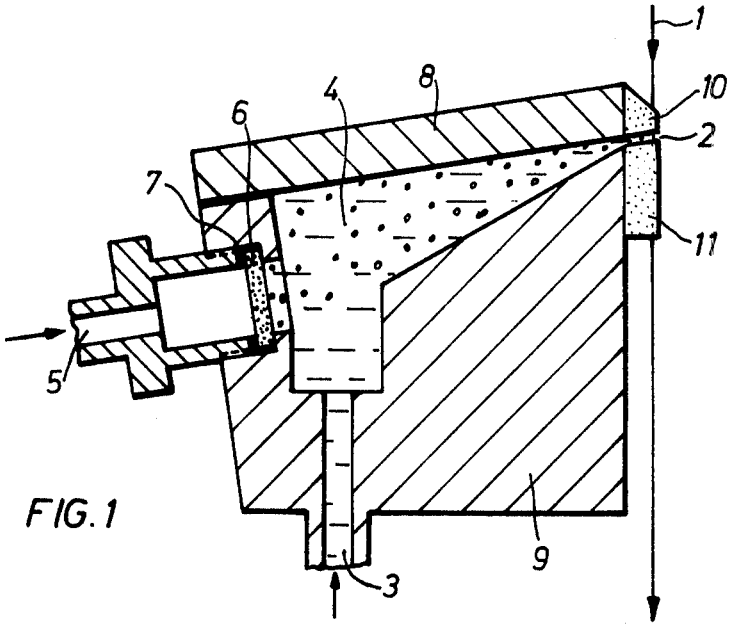
FIG. 1 is a vertical cross-sectional view of one embodiment of an apparatus for performing the process of this invention.

FIGS. 1 to 6 show technical embodiments for coating filaments or fibres with a preparation by the process according to the invention. In FIG. 1, a liquid is delivered under pressure through a feed line 3 into a supply chamber 4 which opens into a slot 2, the outlet opening of which is situated in a wall of the liquid container 9, whose outer surface is concave curved parallel to the wide side of the outlet opening of the slot. This arrangement of the slot provides for improved guiding of the filament on the preparation unit and, at the same time for uniform application of the preparation to the filaments or fibres.

Accordingly, the invention also relates to an apparatus for carrying out the process according to the invention, which is distinguished by the fact that an inner compartment 4 of a liquid container 9 equipped with a feed 3 for a liquid, opens into a horizontal slot, the outlet opening of which is situated in a wall of the liquid container 9 whose outer surface is concave curved parallel to the wide side of the outlet opening of the slot.

A curved guide, preferably made of the same material as the blocks 10 and 11 defining the slot 2, can be arranged about 10 to 30 centimeters parallel to and above the outlet opening of the slot 2, its curvature being in the same direction as the curvature of the slot (see FIG. 7).

The radius of curvature of the guide is such that, in the preparation of slivers, as uniform a distribution of the individual filaments as possible is achieved over the overall width of the slot, and the filaments are prevented from running over or behind one another. The concave opening on the outlet side of the slot 2 is 0.1 to 1 mm tall. For slivers, it is about 10 to 250 mm wide. The radius of curvature amounts to 20 to 200 mm.

If the liquid to be applied is a foam, the apparatus according to the invention can be modified in such a way that a gas feed line 5, opens into the inner compartment 4 of the liquid container 9 by way of a frit 6. However, the foam can also be produced elsewhere and fed to the coater.

Figure 2:
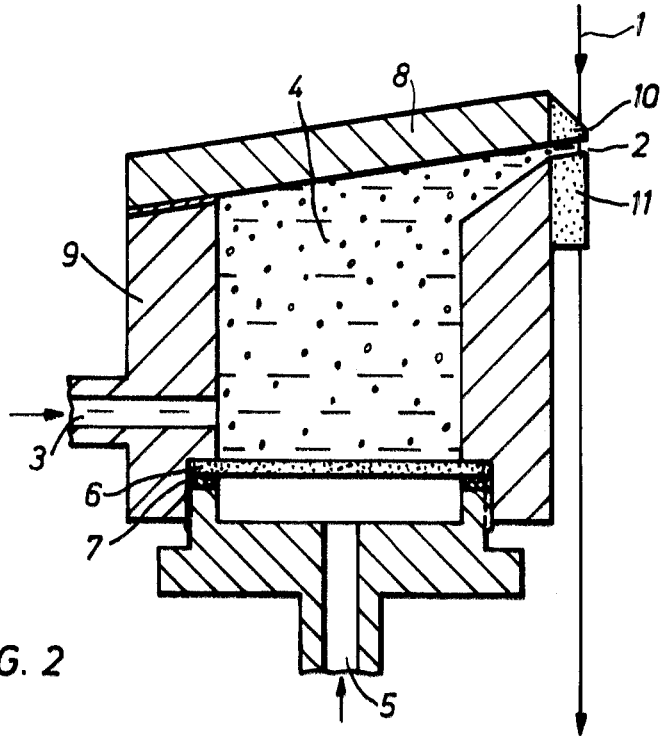
FIG. 2 is a vertical cross-sectional view of another embodiment of an apparatus for performing the process of this invention.

As shown in FIGS. 1, 2 and 5, the outlet opening of the slot 2 is preferably defined by two prism-shaped blocks 10 and 11 arranged mutually parallel and above one another, their outlet-side surfaces parallel to the wide side of the slot having a concave curve. The material for the blocks 10 and 11 is a wear-resistant, hard, smooth or rough material. The blocks 10 and 11 preferably consist of sintered ceramics, nitrides, carbides, oxides or hardened stainless steel. Silicon carbide, aluminium oxide, chromium oxide or wear-resistant non-rusting steels, for example so-called tool steels, are particularly suitable for the blocks 10 and 11 and for the guide 20.

The frit 6, which is used to introduce a gaseous medium through the inlet 5 into the supply compartment 4, is preferably made of perfluorinated polyalkylene. A gear pump is used for delivering the emulsion (dosing) into the supply compartment, the inner wall of the supply compartment 4 being in the form of an inclined plane towards the slot in order to avoid dead zones. The advantages of forced dosing are that dosing is independent of viscosity and that concentrated emulsions can be applied with reproducible results.

As shown in the drawing, the frit 6 can be situated in the liquid container formed by 4 and 9, although it can also be built into the feed line 5 outside the supply compartment 4. Non-wetting or substantially non-wetting frits (e.g. silicone rubber, perfluorinated polyethylene) are preferred. The size of the frits used is governed by the throughput of the gaseous medium (for example air). The smaller the ratio of gas throughput to frit surface, the finer the foam formed.

FIG. 1 is a side view of one embodiment of the apparatus according to the invention.

A bundle of filaments or a single filament 1 travels past a slot 2 made of ceramics material. A liquid, for instance an emulsion, is delivered to the apparatus through the inlet 3 and is then foamed in the foaming compartment 4 by a gaseous medium introduced through the inlet 5 and the frit 6. The reference 7 denotes a rubber seal and the reference 8 a cover plate for the inner or foaming compartment 4. The reference 9 denotes the liquid container or the housing for the foaming compartment. For one-way liquid application, the apparatus according to the invention shown in FIG. 1 can also be made without the gas inlet 5 and without the frit 6.

FIG. 2 is a side view of another embodiment of the apparatus according to the invention (one-way foam coater). The references 1 to 8 in FIG. 2 have the same meanings as in FIG. 1.

FIG. 3 shows the dimensions of the slot. The references 1, 4 and 8 have the same meaning as in FIG. 1. The references 10 and 11 denote the concave blocks which define the curved slot 2. The object of the guide 20 is to improve guiding of the filament.

The section

A characterises the slot height and amounts to from 0.1 to 1 mm,

B is from 1 to 10 mm,

C has a length of 1 to 100 mm,

D is the slot depth and is from 1 to 100 mm.

FIG. 4a is a plan view of the blocks 10 and 11 defining the curved slot 2 in the direction of filament travel. The interval E is 1 to 2 mm wide for a linear slot width F (cord length) of 30 to 40 mm. These two distances determine the curvature of the slot.

FIG. 4b shows an interrupted slot in which the liquid or the foam is fed through the component slots 14.

The partitions 12 can be used as flow guides.

FIG. 4c shows a slot with partial or individual curves 16 into which open the channels 15 which can also be laterally defined by flow guides 13 as in FIG. 4b. The radii of curvature of the individual curves are from 0.05 to 2 mm and their width G from 0.1 to 3 mm.

FIG. 5 is an overall view of an apparatus suitable for applying liquid. The references have the following meanings:

1 = filament

2 = slot (outlet opening)

10, 11 = prism-shaped or similarly shaped blocks concave on one side.

3 = liquid inlet.

17 = spring closure

19 = the apparatus can be moved (adjusted) in the direction of these arrows by a conventional mechanism.

FIG. 6 shows a preferred embodiment of the apparatus according to the invention in which the slot is defined by lateral guide edges 18. The edges are about 0.5 mm long.

FIG. 7 is a view from above in the direction of the bundle of filaments, showing how the threads are guided by means of the guide 20 and the curvatue of the slot. The reference 1 denotes the filaments.

The possibility of fitting the coating unit to the mounting base by means of a spring closure represents another advantage of the apparatus according to the invention. Another major advantage is the adjustability of the coating unit relative to the bundle of filaments or the single filament. This means that the coating unit can be brought up to the bundle of filaments.

The following Examples are to further illustrate the invention without limiting it.

EXAMPLE 1

A polyamide-6 filament yarn stretched to a denier of dtex 940/f 140 was drawn at a spinning take-off speed of 500 m/minute directly past the slot of a one-way liquid application unit of the kind shown in FIGS. 1, 5 and 6 and was prepared with a 24% oil-in-water emulsion (dynamic viscosity: 17 cP at 20° C). The application slot with circular curvature had a linear width (cord length) of 40 mm, a radius of curvature of 134 mm, a height of 0.5 mm and a depth of 4 mm. The slot was formed by 2 curved pieces of carborundum (SiC). The emulsion was forced through the application slot by a gear pump (spinning pump: 0.6 cc. per revolution). The individual fibres of the bundle of fibres were prepared immediately adjacent the slot and took up the emulsion quantitatively and uniformly. Chemical analysis of the preparation content of the filament yarn (5 g sample of each 40 kg package) over a period of 4 weeks showed an oil content of (1.26 ± 0.02)% and a water content of (3.37 ± 0.08)%. The stretching of the resulting filament yarn was clearly better than that of comparable material prepared with a roller. The specific tensile strength was consistently above 80 Rkm roller: 70 to 75 Rkm). The proportion of low quality samples was 0.4% (roller 1.5%).

EXAMPLE 2

A polyamide-6 filament yarn stretched to a denier of dtex 470/f 70 was drawn at a spinning take-off speed of 1000 meters/minute directly past the slot of a one-way liquid application unit of the kind shown in FIGS. 1, 5 and 6 and was prepared with a 27% oil-in-water emulsion (dynamic viscosity: 41 cP at 20° C). The application slot with a circular curvature had a linear width (cord length) of 25 mm and a radius of curvature of 78 mm, a height of 0.25 and a depth of 6 mm. The slot was defined by two curved pieces of $Al_2O_3$. Chemical analyses of the amount of preparation applied to the filament yarn of each package over a period of 6 weeks showed (1.15 ± 0.02)% of oil and (2.80 ± 0.09)% of water.

In spite of the high spinning take-off speed, the 40 kg packages were entirely satisfactory in structure whereas 40 kg packages prepared with a roller under otherwise identical conditions underwent a marked increase in size (approximately 10 cm in the axial direction on a flanged bobbin with a winding width of 44.2 cm, which is placed with axis vertically arranged on one flange whilst the other flange is removed). After stretching on a Rieter stretch-twisting machine specific tensile strengths in the region of 90 Rkm were obtained.

EXAMPLE 3

A polyamide-6 filament yarn stretched to a denier of dtex 1100/f 63 was drawn at a spinning take-off speed of 580 m/minute directly past the slot of a one-way foam application unit of the kind shown in FIG. 2 and was prepared with a foamed 20% oil-in-water emulsion (dynamic viscosity: 9 cP at 20° C). The emulsion was forced into the application unit (756 cc/h) above the capillary system by means of a geared pump (0.6 cc per revolution). The capillary system consisted of a 2 mm thick frit made of polytetrafluorethylene (average pore diameter 30 μm) with a useful surface area of 12 $cm^2$. Filtered air was blown through the frit (6 l/h under normal conditions). The foam produced had a very fine, uniform structure (cell diameter <0.5 mm). The slot system was the same as in Example 1. Chemical analysis of the amount of emulsion applied to the filament yarn of the package over a peroid of 4 weeks showed (1.00 ± 0.02)% of oil and (2.69 ± 0.07)% of water. The filament yarn thus prepared was stretched and textured by the brake chamber process. The filament travelled well, and hardly any filament breakages and stops occurred. Uniformity of texturing and dyeing were clearly better than those of corresponding material prepared by the roller method.

EXAMPLE 4

A polyamide-6 filament yarn stretched to a denier of dtex 2800/f 210 was drawn directly past the slot of the one-way foam application unit described in Example 3 at a spinning take-off speed of 158 m/minute and was prepared with a foamed 30% oil-in-water emulsion (dynamic viscosity: 95 cP at 20° C). The yarn thus prepared was stored in cans. The oil content of the yarn was around (1.69 ± 0.02)%, the water content amounted to (3.51 ± 0.09)%. A very strong, coarse filament yarn of up to 33,000 dtex was prepared by doubling the yarn from several cans followed by stretching. In relation to comparable material prepared by the roller method, (in which context it should be pointed out that only fairly thin emulsions could be safely applied with the roller (≦24% oil), a higher uniformity of application was found, as reflected in an, on average, 5 Rkm higher tensile strength and, in particular, in a very small number of filament breakages (1 per 100 kg).

EXAMPLE 5

A four-strand polyamide-6 filament yarn stretched to a denier of dtex 44/f 10 was drawn in past the interrupted slot on a one-way liquid application unit of the kind shown in FIGS. 1 and 4c at a spinning take-off speed of 1200 m/minute and was prepared with a 12.5% oil-in-water emulsion (dynamic viscosity: 1.8 cP at 20° C). The radius of curvature of the semi-circular slot segments at the rear end of the prism-like filament-guide grooves was 0.25 mm. The slot system was formed from $Al_2O_3$ sintered ceramics. Below each slot segment (in the direction of filament travel), a thin, stable localised emulsion film, through which the filament was drawn, was formed on the sintered ceramics in the filament guide groove. Emulsion was fed to the slot system by forced delivery using a gear pump (spinning pump: 0.3 cc per revolution) and before the slot system was guided in 4 equal component streams to each of the 4 slot segments by flow resistances (rectangular channels: 40 mm long, 0.5 mm deep, 0.3 mm wide). Analyses of the amount of preparation on the threads produced the following results:

a. the average differences from filament to filament at the same time showed deviations of ± 2% for oil and water;

b. the differences in application in one and the same filament dependent on its length or on the spinning time amounted to ± 2% for oil and to ± 4% for water.

In the case of the oil values, the deviations corresponded to the inaccuracy of analysis.

The filaments were stretched and friction-textured by the false-twist process. The uniformity of crimping and dyeing was clearly better than that of comparison material prepared by the roller method.

EXAMPLE 6

A polyethylene terephthalate filament yarn stretched to a denier of dtex 167/f 34 was guided directly past the slot system of a one-way liquid application unit of the kind shown in FIGS. 1 and 4c at a take-off speed of 1300 m/minute. The same application unit as in Example 5 was used. The spinning preparation had an oil concentration of 20%. The filament yarn of all the packages produced from the 4 threads showed high uniformity of application over a period of 5 weeks both from filament to filament and in each individual filament as a function of time. The speed of the gear pump was adjusted so that an average oil application of 0.75% by weight, based on the fibre mass, was achieved. A value of (0.74 ± 0.02)% was found. The filament yarn prepared in this way, was stretched and textured by the false-twist process. The yarn travelled satisfactorily through the machine. Fluctuations in bulking were appreciably lower than in material prepared by the roller method. Roller preparation at 1300 m/minute resulted in a very uneven application of oil with fluctuations of up to ±20%.

EXAMPLE 7

20 polyamide-6 monofilament yarns with individual deniers of 400 dtex were continuously subjected after fixing to one-way liquid preparation by the process according to the invention at a speed of 240 m/minute. The monofilaments were guided horizontally at intervals of 7 mm from one another. A unit of the kind shown in FIGS. 1 and 4c was used for application, the monofilaments running in horizontal guide grooves (16 in FIG. 4c). Brightening was carried out with a 20% oil-in-water emulsion with the dynamic viscosity of 70 cP at 20° C delivered by a gear pump and forced through the curved slot segments of the application unit. 2.2% of oil was applied. The fluctuations in oil application amounted to ±0.13% from monofilament to monofilament, based on the average oil content of the monofilaments. This brightening process made the monofilaments much safer to process on weaving machines with filament speeds of 600 m/minute than monofilaments that had been brightened by a roller. In addition, it was readily possible by the process according to the invention uniformly to obtain any output of oil requested by customers to suit their machine settings. This was not possible with preparation rollers.

We claim:

1. An apparatus for applying a liquid preparation to a freshly spun synthetic sliver which passes perpendicularly and in close relationship to a horizontal concave slot disposed in a vertically oriented dispensing surface from which is forced said liquid preparation, the apparatus comprising a liquid storage chamber which is connected to the said slot by an upwardly inclining passageway, the liquid being supplied to the storage chamber by a continuously operated, precisely controlled gear pump, said slot having a height of 0.1–0.3 mm., a depth of 10–40 mm, and a radius of curvature of 20–200 mm., said slot being formed by two parallel prism-shaped solid materials made from the group consisting of sintered ceramic, nitride, carbide, oxide, or abrasion-resistant steel, said storage chamber being fitted with a frit of perfluorinated polyalkylene through which gas is delivered under pressure to produce foaming in said liquid inside said storage chamber, and thereby produce a foamed liquid issuing from said slot for application to said sliver and a curved guide element disposed in parallel with the upper element forming the slot and operatively associated therewith to form a guide for said perpendicularly passing sliver.

2. An apparatus as claimed in claim 1, wherein the width of the slot amounts to between 10 and 250 mm.

* * * * *